United States Patent [19]

Mack et al.

[11] 4,396,011

[45] Aug. 2, 1983

[54] HEATING PAD

[75] Inventors: William Mack, Commack, N.Y.; Gerald K. Pitcher, Stamford, Conn.

[73] Assignee: Clairol Incorporated, New York, N.Y.

[21] Appl. No.: 223,624

[22] Filed: Jan. 9, 1981

[51] Int. Cl.[3] ..... A61H 21/00

[52] U.S. Cl. ..... 128/24.2

[58] Field of Search ..... 128/24.1, 24.2, 32, 128/34–37

[56] References Cited

U.S. PATENT DOCUMENTS

| | | | |
|---|---|---|---|
| 2,540,792 | 2/1951 | McCready | 128/41 |
| 3,019,784 | 2/1962 | Eiden | 128/24.2 |
| 3,071,132 | 1/1963 | Lucht | 128/36 |
| 3,310,050 | 3/1967 | Goldfarb | 128/41 |
| 3,710,784 | 1/1973 | Taylor | 128/24.2 |
| 3,981,032 | 9/1976 | Brooks | 128/33 |

OTHER PUBLICATIONS

Smith, *Circuits, Devices and Systems*, Rectifiers, at p. 315, ©1976 Wiley.
ID Filters at p. 178

*Primary Examiner*—Richard J. Apley
*Assistant Examiner*—R. C. Moy
*Attorney, Agent, or Firm*—Isaac Jarkovsky; John J. Balser; Gerald S. Rosen

[57] ABSTRACT

There is disclosed a vibrating electric heating pad connected to a vibrator having a vibrating plate suspended in foam plastic in the vibrator housing and a control module with a slide switch and a transformer/rectifier. In a preferred embodiment, the vibrator is attached by velcro strips to the heating pad, and via a jack to the control module. The control module is also electrically connected to the heating pad and controls the heating pad and the vibrator.

1 Claim, 9 Drawing Figures

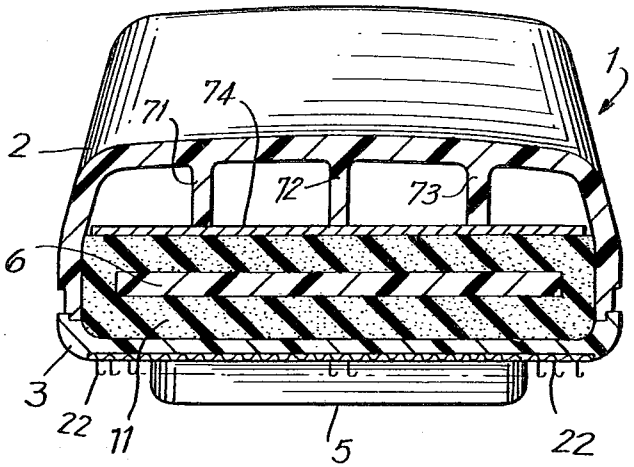
FIG. 3
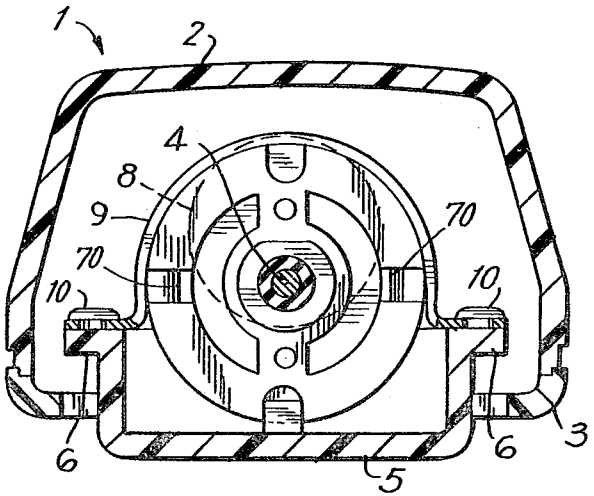
FIG. 4
FIG. 2
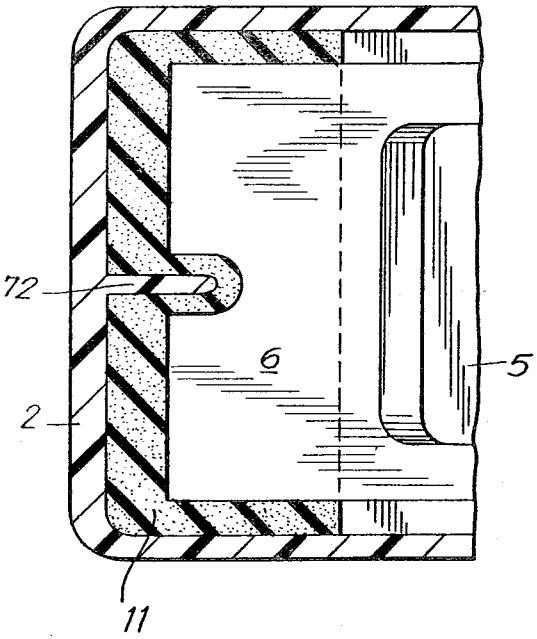

HEATING PAD

DESCRIPTION

BACKGROUND OF THE INVENTION

This invention relates to a heating pad in combination with a vibratory device for massaging a portion of the anatomy and a control module for controlling the heating pad temperature and the motor in the vibratory device.

Many types of heating pads, in combination with a vibrator and a control module, are known in the prior art.

Taylor, U.S. Pat. No. 3,710,784, issued Jan. 16, 1973 discloses a heating pad with a removable vibrator wherein both the heating pad and vibrator are controlled by a control module. The vibrator contains a motor with eccentric weights rigidly attached to a flexible vibrating plate. The plate has projections extending from a surface thereof which fit into openings in the heating pad.

The Taylor vibrator is constructed so that not only does the vibrating plate vibrate, but also the vibrator housing. This causes the Taylor vibrator to be vulnerable to dampening when, for example, weight or pressure is applied to the housing. Because of the foregoing, the motor required to achieve a desirable vibration intensity is relatively large and heavy and the power requirements are high. In addition, the vibrator is inconvenient to use since it requires a pad which is made especially to receive the projections on the vibration plate. The control module contains adjustable knobs for controlling the speed of the vibrator and the temperature of the heating pad. The circuitry has resistors and field windings. Thermostats are also provided. There is no means for detachably connecting the vibrator to the control module.

Ross, U.S. Pat. No. 2,800,897, issued July 30, 1957 discloses a vibrator motor associated with a heating pad in a pillow. The motor has a rotary eccentric weight and is resiliently mounted within a housing by means of a plurality of rubber blocks extending between the inner surface of the housing and the outer surface of the motor. The vibration is conducted through the blocks to the housing.

Various body massagers with vibratory motors are disclosed in Suarez, U.S. Pat. No. 3,068,858, issued Dec. 18, 1962; Carpenter, U.S. Pat. No. 3,457,911, issued July 29, 1969; and Carruth, U.S. Pat. No. 3,854,474, issued Dec. 17,1974.

Rotary vibration motors are disclosed in Ross discussed above, McMillan et al, U.S. Pat. No. 2,920,619, issued Jan. 12, 1960; Eiden, U.S. Pat. No. 3,019,784, issued Feb. 6, 1962; Eiden, U.S. Pat. No. 3,019,785, issued Feb. 6, 1962; Ziff, U.S. Pat. No. 3,062,203, issued Nov. 6, 1962; Abramovitz, U.S. Pat. No. 3,762,402, issued Oct. 2, 1973; and Knop, U.S. Pat. No. 3,799,154, issued Mar. 26, 1974.

Cordless vibrators are disclosed in Martin, U.S. Pat. No. 3,234,933, issued Feb. 15, 1966; Richardson, U.S. Pat. No. 3,358,309, issued Dec. 19, 1967; and Tavel, U.S. Pat. No. 3,451,391, issued June 24, 1969.

Removable vibrators are disclosed in U.S. Pat. No. 3,981,032, issued Sept. 21, 1976; Roberts, U.S. Pat. No. 3,601,121, issued Aug. 24, 1971; McElwee, U.S. Pat. No. 2,850,009, issued Sept. 2, 1958; Mabuchi, U.S. Pat. No. 3,996,929, issued Dec. 14, 1976; and Goldfarb, U.S. Pat. No. 3,310,050, issued Mar. 21, 1967.

Heating pads with wire vibrators are disclosed in Parker, U.S. Pat. No. 1,158,834, issued Nov. 2, 1915; and Vecchio, U.S. Pat. No. 2,949,108, issued Aug. 16, 1960.

The prior art above does not teach a vibrator suitable for use with a heating pad having a floating vibrating plate which does not transmit any substantial vibration to the motor housing. In addition there are no control modules taught which are attached to a heating pad and have a transformer/rectifier and a jack for receiving a plug from a vibrator. Also, there are no removable vibrators which are adhered to heating pads by Velcro.

There is a need for a heating pad which can be used with a vibrator which vibrator is not vulnerable to dampening, has a relatively small, light motor with low power requirements, and can be attached by a jack plug to a control module having a transformer/rectifier therein.

SUMMARY OF THE INVENTION

This invention provides a heating pad in combination with a detachable vibrator and a control module. The vibrator, light in weight, is not vulnerable to dampening and can be removably attached to the control module. The control module is permanently attached by an electric power cord to the heating pad. It has a jack socket for receiving a jack plug of the vibrator and it contains, in the housing, a combination step-down transformer/-rectifier, a multiposition slide switch and optionally a radio frequency filter. There is also present in the housing a neon indicator light which indicates whether or not the switch is on. The housing is hollow and is constructed from an upper housing and a lower housing rigidly attached. It is made of impact resistant plastic. The vibrator is comprised of a housing having therein a rotating motor with an eccentric weight. The vibrator housing is contructed from an upper housing and a lower housing fixedly connected. The lower housing has a large opening in which a vibration plate is suspended. The vibration plate projects from the opening and is isolation suspended in a resilient foam in the lower housing. The motor is attached to the vibration plate either by means of a bracket, or directly.

It is an object of this invention to provide an electric heating pad in combination with an electrically powered portable vibrator with a vibrating plate that does not impart significant vibration to the vibrator housing and a control module with a transformer/rectifier, and a multiposition slide switch and which controls both the vibrator and heating pad.

BRIEF SUMMARY OF THE DRAWINGS

FIG. 2 is a top sectional view of the vibrator taken along line 2—2 of FIG. 1 showing the foam cushion which supports the vibration plate;

FIG. 3 is an end sectional view taken along line 3—3 of FIG. 1 showing the relationship of the vibration plate, foam cushion and housing;

FIG. 4 is a sectional view taken along line 4—4 of FIG. 1 showing the motor and motor bracket;

DETAILED DESCRIPTION

Figure 1:
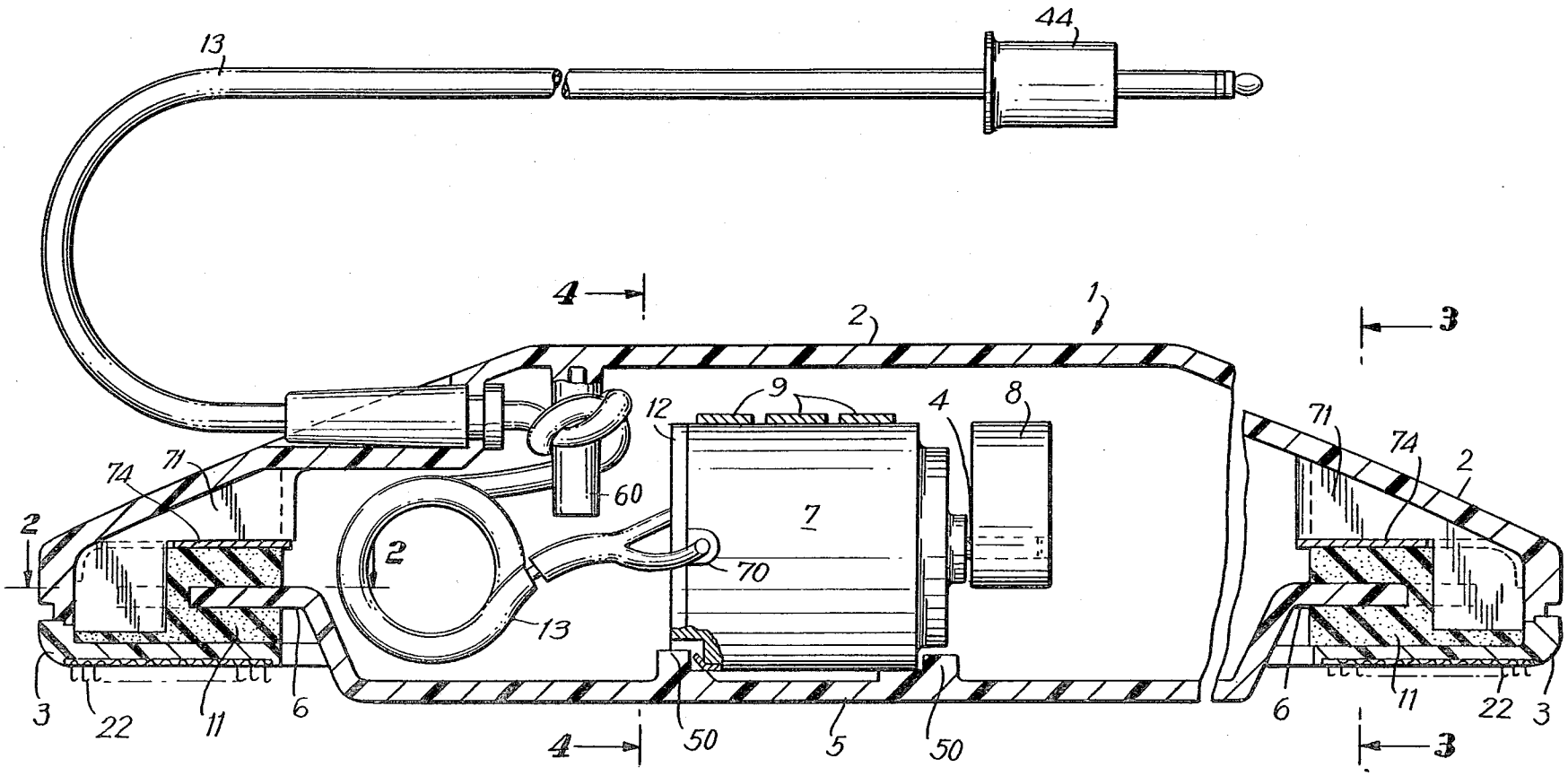
FIG. 1 is a side elevational view of the vibrator used in this invention.
Figure 7:
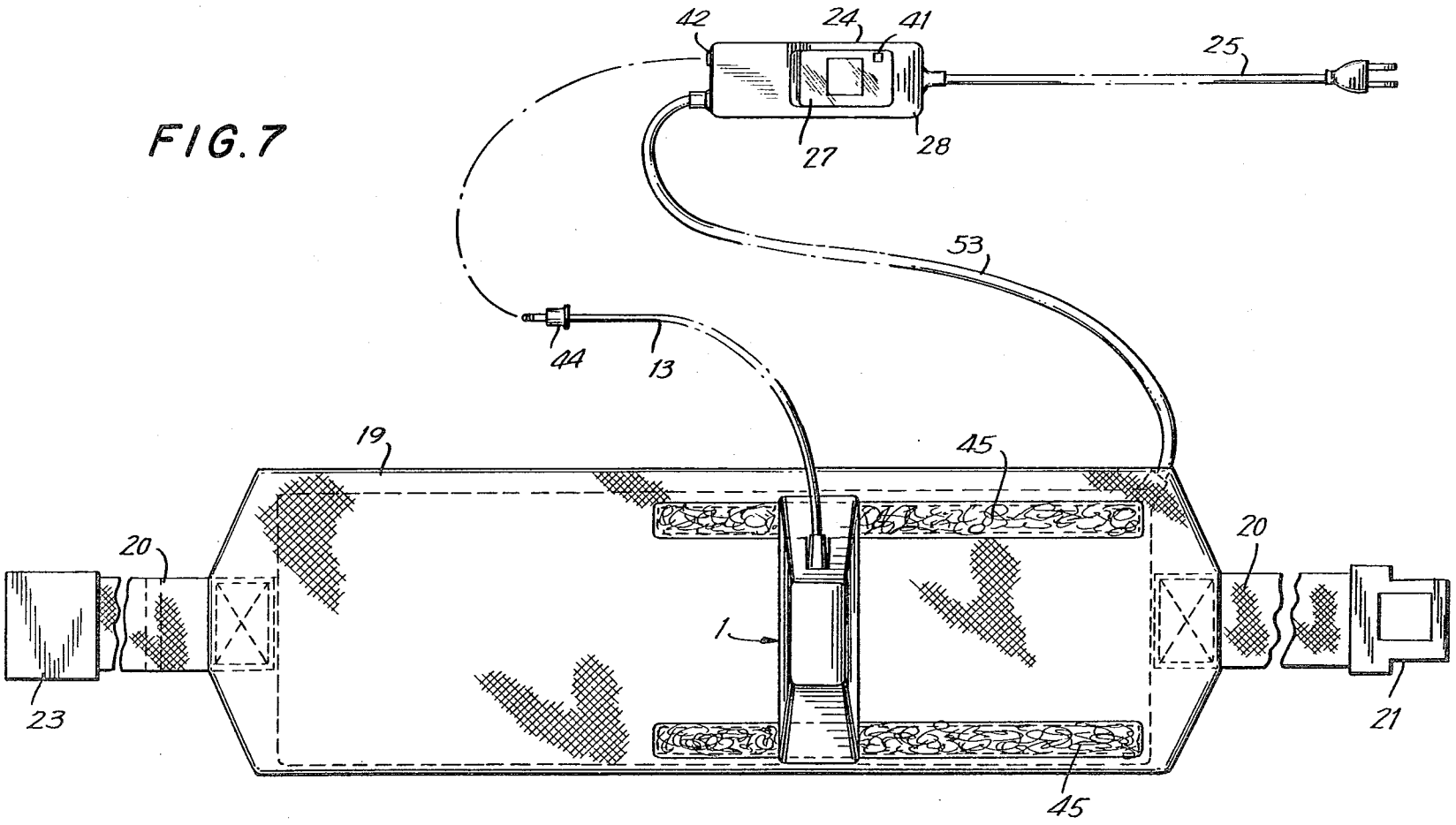
FIG. 7 is a top plan view of the vibrator on a heating pad.

As shown in FIG. 1, the vibrator used in this invention comprises a hollow vibrator housing 1 containing therein an electrical vibration motor 7. The motor 7 is powered by electricity received through a cord 13 which can be attached to the motor 7 by tabs 70 and to the control module 24 depicted in FIGS. 8 and 9 through a jack plug 44, as shown in FIG. 7. The control module 24 receives power from a power cord 25 which plugs into an electric outlet, not shown.

The hollow vibrator housing 1 is comprised of an upper housing 2 and a lower housing 3, each made of an impact resistant heat stable, molded plastic. The upper housing 2 and lower housing 3 are attached at their peripheral edges by any conventional means, however, ultrasonic welding is preferred. The vibrator housing 1 viewed from the top or bottom can be of any shape which is suitable for holding in the hand, a generally rectangular shape is preferred. Viewed from the side, the housing 1 can be generally rectangular or the upper corners can be removed so the upper housing 2 has a three surface top. The shape of the vibrator housing 1 is not critical to the invention, however, it should be of such a shape and size that a vibrating motor can fit inside.

The lower housing 3 has an opening in the bottom thereof of generally rectangular shape into which a vibration plate 5 is inserted. Preferably the opening is centrally located.

The vibration plate 5 is generally of a rectangular dish shape with a flat base and an outward extending flange 6 around the periphery. The flange 6 is generally parallel to the base of the vibration plate. The flange 6 fits into the housing 1 at about the level of the seam where the upper housing 2 and lower housing 3 are attached. The flange 6 is supported by a foam cushion 11, which is in the housing 1 around its inside circumference where the upper housing 2 and lower housing 3 are attached as shown in FIGS. 1, 2 and 3. The flange 6 is surrounded by the foam cushion 11, as shown in FIGS. 1 and 3. The foam cushion 11 is preferably a polyether polyurethane foam. However, any foam cushion can be used if it has sufficient stability under the conditions of use and is sufficiently elastic to permit the vibration plate 5 to move as described below.

The base of the vibration plate 5 is smaller in its outside dimensions than the opening in the lower housing 3. In addition, the upper housing 2 has spaced apart rigid ribs 71, 72 and 73 depending downward toward the foam cushion 11 and resting on a thin roof 74 over the foam cushion 11. The roof 74 is made of stiff paper or plastic and provides a support for the cushion 11 to press against when the vibration plate 5 moves. The center rib 72, as shown in FIG. 2 deforms the sponge 11 so the vibration plate 5 can move without hitting the housing 1. The dotted lines in FIG. 1 show the lateral movement of the vibration plate 5. This permits the vibration plate 5 to vibrate without contacting the housing 1. The foam cushion 11 which supports the vibration plate 5 in the housing 1 has sufficient elasticity to enable the plate 5 to be pushed until its base is flush with the bottom of the lower housing 3. However, the roof 74 and insufficient give to the foam 11 prevent the plate 5 from contacting the housing 1. This independent suspension in the foam cushion 11 enables the plate 5 to move in a floatng pulsating motion. The vibration plate 5 can be flexible, inflexible or partially flexible. Preferably, it is made of an inflexible impact and heat resistant molded plastic.

The vibrator motor 7, having an eccentric weight 8 on its rotary shaft 4, is attached to the vibration plate 5. The attachment can be a slotted bracket 9 which can be attached to the vibration plate 5 by fasteners 10, e.g. rivets, bolts, and welded to the motor 7 as shown in FIG. 4. The motor 7 is held in place between bosses 50 on the inner surface of the vibration plate 5. This ensures that the vibration caused by the motor 7 is minimally conducted to the housing 1 and maximally conducted to the vibration plate 5. Because the plate 5 is suspended in the foam cushion 11, it cannot conduct any substantial vibration to the housing. The vibration action of the plate 5 is, because it is free floating, an orbiting movement that feels like fingers massaging rather than vibration in one plane which is characteristic of conventional magnetic vibrators. The desirable orbiting movement effect is enhanced by the manner in which the motor 7 is attached to the vibration plate 5. If the rear end bell 12 of the motor 7, opposite the eccentric weight 8 is fixed securely to the vibration plate 5, either at a right angle, or by a bracket 9, mounting it to the plate 5 so that the axis of the motor 7 is substantially between a right angle (90°) to parallel to the vibration plate 5, this mounting causes the motor 7 and plate 5 to move in an orbiting movement with massaging action. The mass of the motor 7 and plate 5 together with the spring rate of the foam cushion 11 comprises a spring-mass system forced by the eccentric swinging weight 8, materially increasing the efficiency of the system so that very little power is required.

Figure 8:
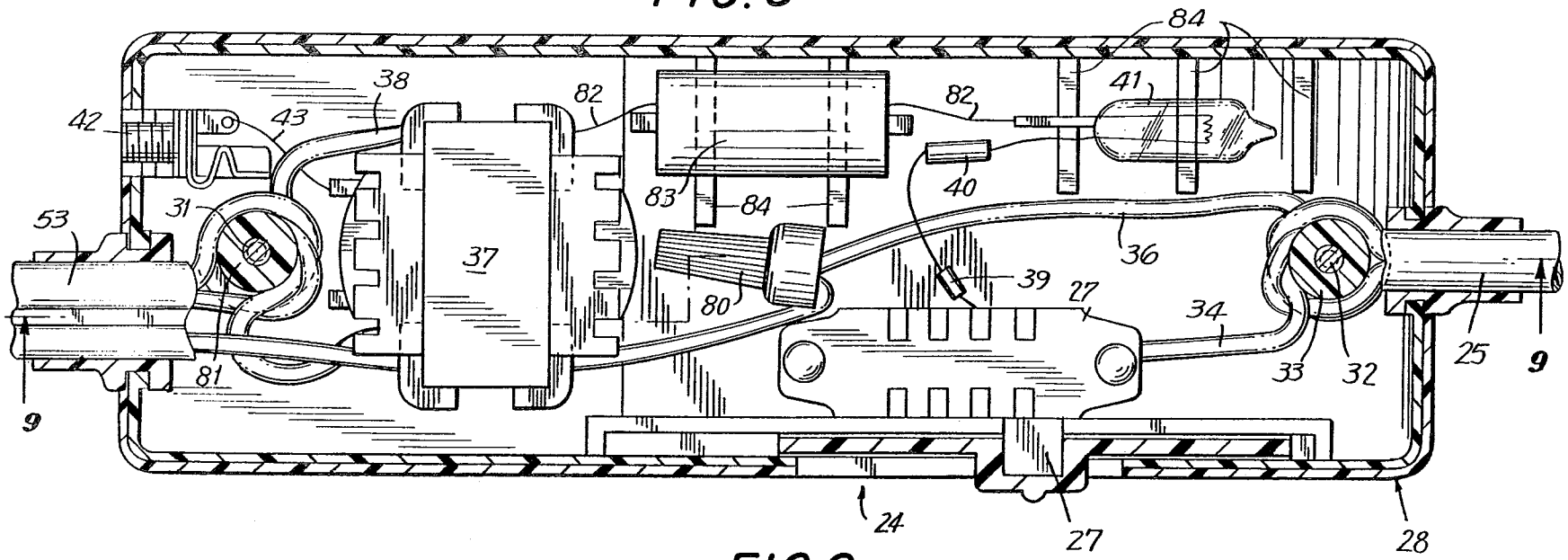
FIG. 8 is a top plan view in section of the control module.
Figure 9:
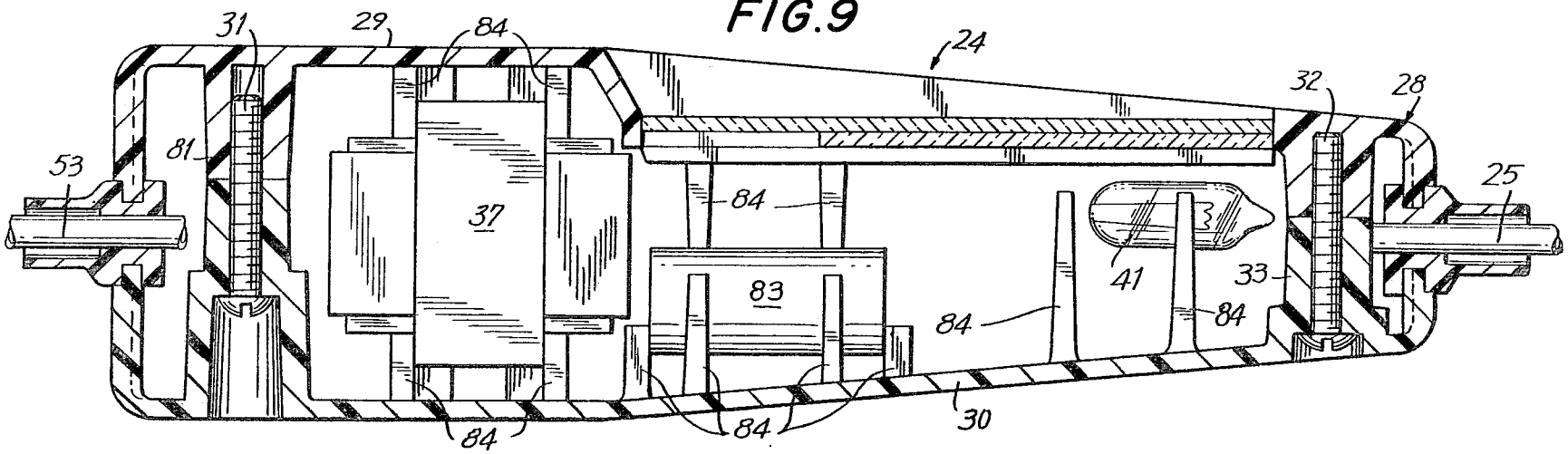
FIG. 9 is a side elevational view in section of the control module.

The motor 7 of the vibrator shown in FIG. 1 is connected to a jack socket 42 in the control module 24 depicted in FIGS. 8 and 9, by a cord 13 with a jack plug 44. The cord 13 enters the housing 1 of the vibrator and is wrapped around a strain release post 60, then is connected to the motor 7 by tabs 70 on each side of the motor 7. The control module 24 is connected to a power source by a power cord 25 as shown in FIG. 7.

The control module 24 operated by a slide switch 27, operates to turn the vibrator motor 7 on and off and also can control its speed by inclusion of a rheostat. The control module 24 also controls the heating element 90 in the heating pad 19, depicted in FIG. 6.

The motor 7 used can be relatively small and still give the desired effect. Thus, for example, a motor of about 1500–2400 RPM, preferably 1600–2000 RPM, most preferably 2000 RPM are suitable.

The control module 24 as shown in FIGS. 8 and 9, is a combination of a step-down transformer/rectifier 37 and a multi-position slide switch 27 in a single control module.

The control module 24 is connected to the heating pad with a three wire cord 53, to the vibrator depicted in FIGS. 1–5 by means of a jack socket 42 which receives a jack plug 44 from the vibrator, and an outside power source with power cord 25. The control module 24 comprises a hollow housing 28 made of an upper housing 29 and a lower housing 30 held rigidly together by screws 31 and 32. The control housing 28 is made from an impact resistant plastic.

Inside the control housing 28 are located the wire strain release 33 around which the outside power source cord 25 is placed, the power source cord 25 has one wire lead 34 to a slide switch 27 and another wire lead 36 through a connector 80 to a step-down transformer 37. The step-down transformer 37 can be a full wave center tap rectified 3 watt, 4.5 volt open circuit, and 1.35 volts at 500 milliamperes when loaded. This transformer 37 reduces and rectifies the incoming 110 volts alternating current to under 20 volts direct current to the vibrating motor 7, by wire 43, jack socket 42 and disconnectable jack plug 44 through wire 13 as shown in FIGS. 7 and 8. The transformer 37 is also electrically connected by wires 38 around wire strain release 81 to the cord 53 leading to the heating pad 19.

The switch 27, a two pole, four position unit, is electrically connected through a diode 39 and a resistor 40 to a neon lamp 41 which indicates whether the switch is on or off. The neon lamp 41 is also connected electrically either directly by wire 82 to the transformer 37 and thence to the jack socket 42 or indirectly through a capacitor 83 which acts as a radio frequency filter.

The transformer 37 is also electrically connected to a phone type jack socket 42 by wires 43. The jack socket 42 receives a connecting male plug 44 from the vibrating motor 7 by a cord 13.

The slide switch 27 can have from three to five pole positions depending on the use intended. When used with the vibrator shown in FIGS. 1–5 and the heating pad 19, as shown in FIGS. 6 and 7, there are four poles, off, low heat, high heat and medium heat. According to the preferred embodiment of the invention, when the heating pad 19 is turned on, the vibrating motor 7 is also turned on. If heat only is desired, the jack plug 44 is unplugged, turning off the vibrator motor 7.

Inside the hollow housing 28 of the control module 24 are projections 84 on the inside wall of the housing 28 which support and hold the various structures contained therein.

Figure 5:
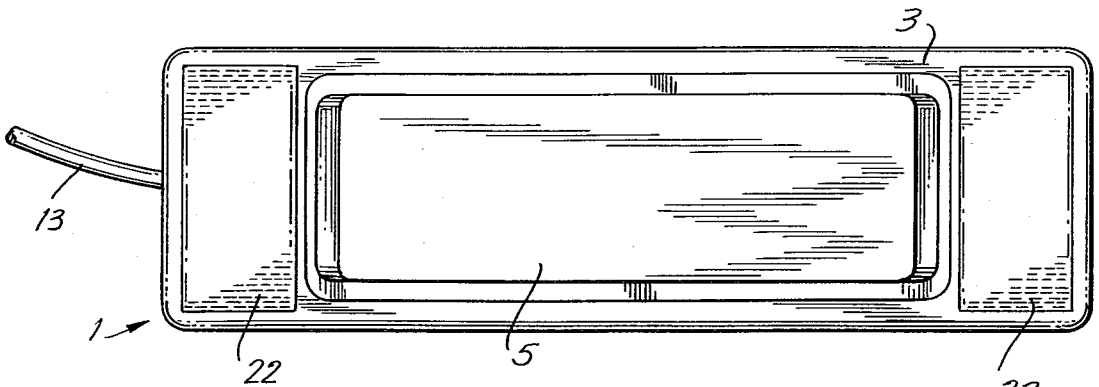
FIG. 5 is a bottom plan view of the vibrator.
Figure 6:
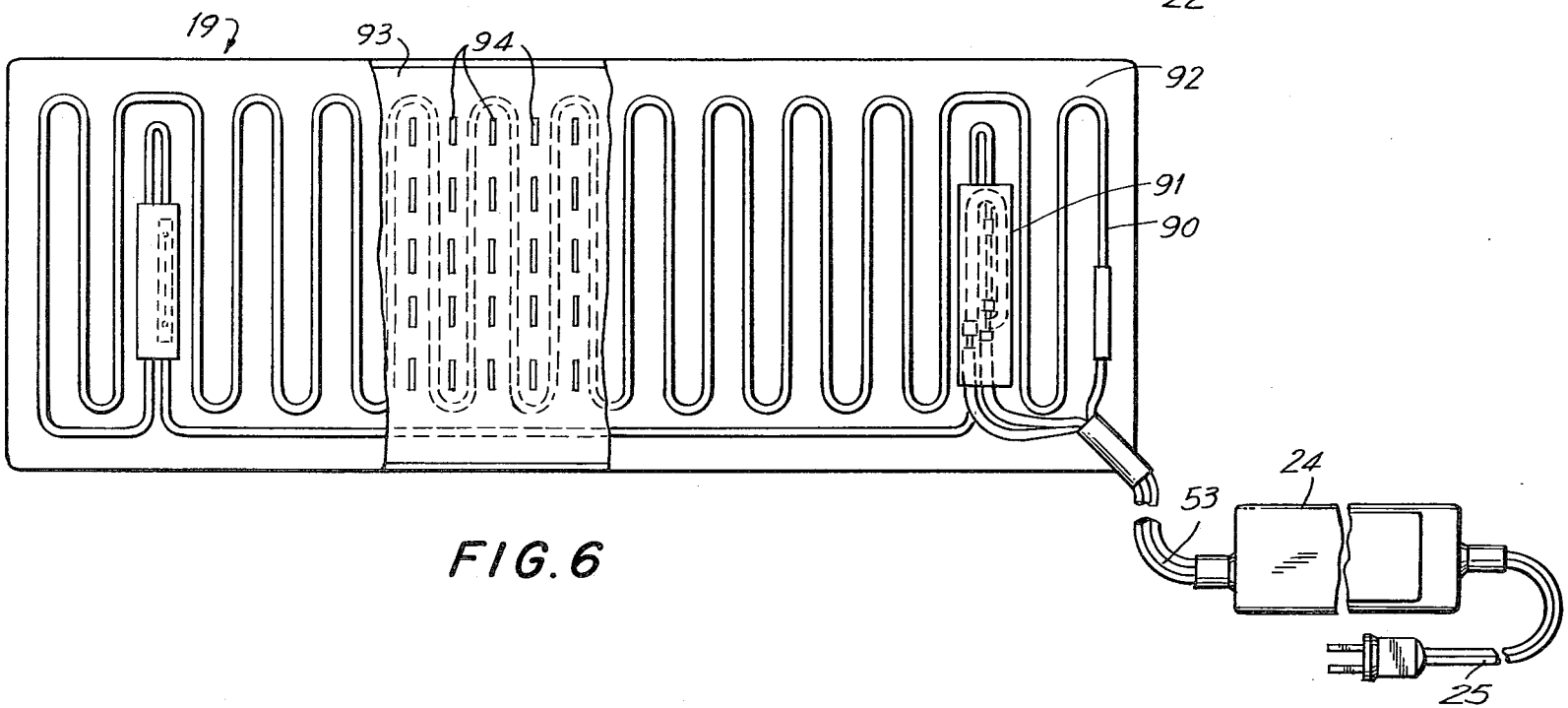
FIG. 6 is a top plan view of a typical heating pad used in this invention.

The vibrator housing 1, as shown in FIGS. 1, 3 and 5 has detachable fasteners 22 such as Velcro hooks as illustrated, removable adhesive fasteners or snaps on the bottom surface of the lower housing 3, at each end. These fasteners 22 adhere to the cover, usually cloth, of the heating pad 19. The cover of the heating pad has matching Velcro loop strips 45. Other fasteners such as a series of snaps can be used if the vibrator has matching snaps.

The heating pad 19 as depicted in FIG. 6, is of a conventional wrap-around design with a cloth cover containing Velcro loop fasteners 45 for receiving the Velcro hooks 22 on the vibrator. The heating pad 19 has wire heating coils 90 inside and a thermostat 91 to prevent overheating. The heating coils 90 are held in place by a flexible wire screen 92. The heating coils 90, screen 92 and thermostat 91 are held in place by a vinyl cover 93 which is spot heat sealed 94 between the loops of the wire heating coils 90. The pad 19 can be held in place on the body by a belt 20, with a buckle comprising a female locking member 23 and a male locking piece 21. The belt 20 is attached to a cloth outer cover.

In a preferred operation of this invention, the control module 24 is electrically connected to the heating pad 19 by cord 53 and electrically connected to the vibrator by cord 13 which is plugged into a jack socket 42 on the control module 24 with jack plug 44.

The heating pad 19 is then wrapped around the part of the anatomy to be treated and then held in place by the belt 20 which is buckled by inserting the male locking piece 21 into the female receptacle piece 23. The vibrator is then placed on the velcro loop strip fasteners 45 at the desired location. Electric power is then supplied to the control module 24 by plugging the power cord 25 into an electric outlet, not shown. The slide switch 27 is then turned to the appropriate control position causing the heating coil in the heating pad 19 to get warm and the vibrator motor 7 to vibrate. This causes the vibration plate 5 to vibrate against the heating pad 19 with the result that the vibration is transmitted to the anatomy.

We claim:

1. A vibrating electric heating pad comprising:

a vibrator;

a control module; and a heating pad;

wherein said vibrator comprises a housing having therein a rotary motor with an eccentric weight on its shaft; said motor being attached to a dish shaped vibration plate protruding through an opening in the base of said housing; said dish shaped vibration plate having a flat base and an outwardly extending flange around the periphery thereof; said flange being surrounded and supported by a foam cushion mounting in said housing so that said vibration plate does not come in contact with said housing; said vibrator being physically attached to said heating pad by detachable fasteners;

and wherein said control module is electrically connected to said vibrator motor by a jack socket which receives a jack plug connected to said vibrator motor and said control module is permanently attached by an electric power cord to said heating pad;

and wherein said control module comprises a housing having therein a main power cord for plugging into an electrical power source; said main power cord having one lead thereof electrically connected to a step down transformer rectifier through a multiposition slide switch and radio frequency filter and said main power cord having the other lead thereof directly connected to said step down transformer/-rectifier;

and wherein an output lead of said transformer/rectifier is electrically connected to said heating pad for energization thereof;

and wherein another output lead of said transformer/rectifier is electrically connected to said jack socket which receives said jack plug connected to said vibrator motor whereby rectified direct current is supplied to said vibrating motor for energization thereof.

* * * * *